US005373107A

United States Patent [19]

Thomas et al.

[11] Patent Number: 5,373,107

[45] Date of Patent: Dec. 13, 1994

[54] INSULATING COVER FOR A WIRE JOINT

[76] Inventors: John R. Thomas, W283 N3312 Lakeside Rd., Pewaukee, Wis. 53072; Chris W. Korinek, W61 N378 Washington Ave., Cedarburg, Wis. 53012; Robert W. Kruse, 219 Warren Ave., Rockford, Ill. 51107

[21] Appl. No.: 975,233

[22] Filed: Nov. 12, 1992

[51] Int. Cl.[5] ..... H01R 4/22

[52] U.S. Cl. ..... 174/87; 174/138 F

[58] Field of Search ..... 174/87, 138 F

[56] References Cited

U.S. PATENT DOCUMENTS

| | | | |
|---|---|---|---|
| 2,973,404 | 2/1961 | Anderson | 174/87 |
| 3,107,273 | 10/1963 | Schinske et al. | 174/138 F |
| 3,132,202 | 5/1964 | Wolf | 174/87 |
| 3,139,481 | 6/1964 | Swanson | 174/138 F |
| 3,194,878 | 7/1965 | Schneiderman | 174/138 F |
| 4,839,473 | 6/1989 | Fox et al. | 174/138 F |

FOREIGN PATENT DOCUMENTS

| | | | |
|---|---|---|---|
| 568195 | 12/1958 | Canada | 174/87 |

*Primary Examiner*—Morris H. Nimmo
*Attorney, Agent, or Firm*—Quarles & Brady

[57] ABSTRACT

An insulating cover for a wire joint has a body which defines a lumen particularly adapted for receiving a crimp sleeve type wire joint. Longitudinal or coaxial ribs adjacent to a closed end of the lumen define an inside diameter which engages a relatively smaller joint, and the ribs are sufficiently flexible and the body stretchable so that the cover can alternatively receive a larger joint. A flexible skirt depends from the body and an elastic strap extends from the skirt with a ring retainer on the strap so that the strap can be extended through the crotch of the joint and secured to the body.

6 Claims, 2 Drawing Sheets

FIG. 1
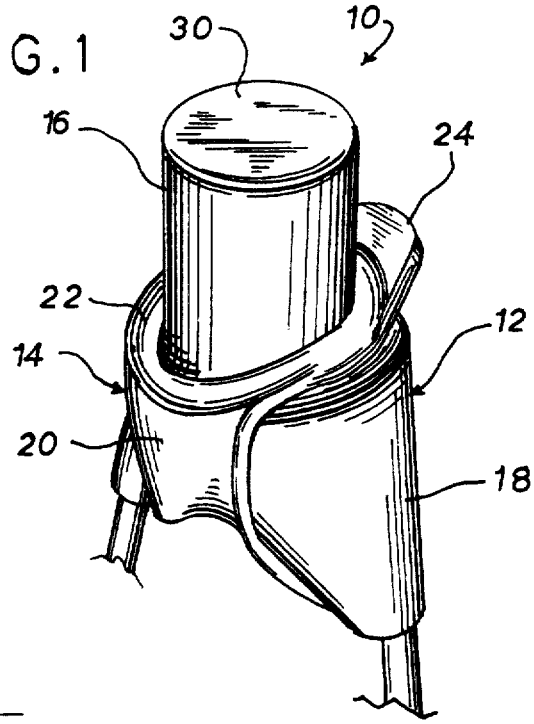
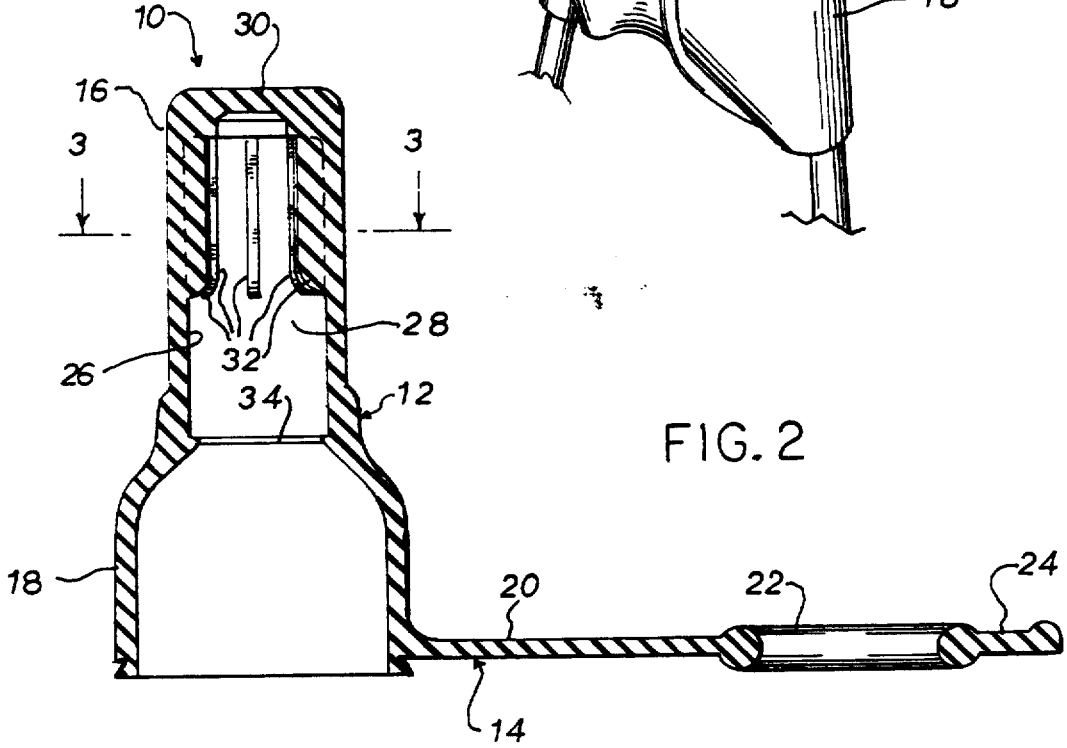
FIG. 2
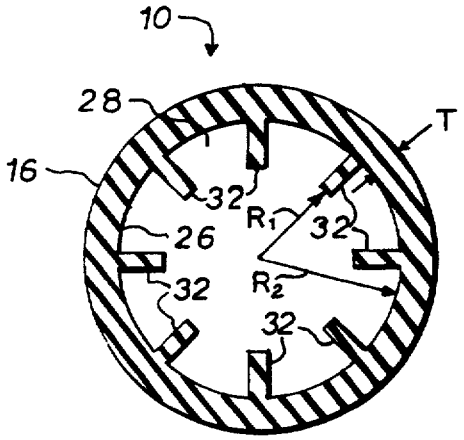
FIG. 3

INSULATING COVER FOR A WIRE JOINT

FIELD OF THE INVENTION

This invention relates to insulating covers for a wire joint, and particularly to such covers which are adapted for insulating a crimp sleeve type wire joint.

BACKGROUND OF THE INVENTION

Elastomeric insulating covers for crimp sleeve type wire joints are known. Examples are described in U.S. Pat. Nos. 3,139,481 and 3,107,273.

These types of insulators are particularly adapted for wire joints in which the ends of two or more wires are stripped of insulation and brought together pointing in generally the same direction. A generally tubular or bell shaped crimp sleeve, usually made of a conductive metal such as copper or a copper alloy, is then slipped over the wire ends and crimped thereto using a pliers-like tool to secure the wire ends together. The insulating cover is usually molded of an elastomeric material and has a cap and an elastic strap extending from the open end of the cap. The cap is placed over the crimp sleeve and the strap is pulled into the crotch between the wires. The end of the strap opposite from the cap has a ring or other means to attach to the cap so as to secure the insulating cover over the wire joint.

These types of covers are fast and easy to use, can be removed, and can be reused. However, there are many different size crimp sleeves which may be used, depending upon the size and number of wires to be joined. In the past, for a tight fitting cover, it was necessary to make a different insulating cover for each different size crimp sleeve. Otherwise, if the same cover was used for two different sizes, it would be loose on the smaller of the two sizes, which is undesirable for the electrical integrity of the joint since dirt or other possibly conductive foreign matter could readily enter the cover with a loose fit, and also for the appearance of the covered joint. This required keeping a relatively large inventory of different covers on hand, and resulted in increased tooling and distribution costs. Therefore, a need exists for an insulating cover which can be used with more than one size crimp sleeve.

SUMMARY OF THE INVENTION

The invention provides a cover especially adapted for electrically insulating a crimp sleeve type wire joint which overcomes the above disadvantages. The cover has an elastic generally tubular body which has an interior surface defining a lumen, with an end closing one end of the lumen, the opposite end of the lumen being open. A flexible skirt depends from the body at the open end of the lumen and defines an opening into the lumen. An elastic strap is fixed at one end to an end of the skirt which is opposite from the body, and a retainer is fixed to the strap at an end of the strap opposite from the skirt. The retainer is engageable with the body when the cover is placed over a wire joint so that the strap extends through a crotch cf the wire joint. The interior surface of the body includes spaced apart ribs which define an inside diameter within the lumen to fit one size wire joint in a compression fit, and which are flexible to deform so as to accomodate insertion of a second size wire joint larger than the one size. Thereby, a single cover can be made to fit at least two different size joints, reducing inventory, tooling, distribution and associated costs.

In another aspect, the ribs extend longitudinally. The wall of the body between the ribs is of a reduced thickness, so that it can readily stretch to accommodate the larger size crimp sleeve. Preferably, the ribs are axially positioned adjacent to the closed end of the lumen, so that both sizes of crimp sleeves extend substantially all of the way into the cover, which provides a tighter fit of the cover on the joint.

BRIEF DESCRIPTION OF THE DRAWINGS

FIG. 1 is a perspective view of an insulating cover of the invention shown assembled to a wire joint;

FIG. 2 is a longitudinal cross-sectional view of the insulating cover of FIG. 1 shown alone;

FIG. 3 is a cross-sectional view taken along the plane of the line 3—3 of FIG. 2;

DETAILED DESCRIPTION OF THE PREFERRED EMBODIMENT

Figure 4:
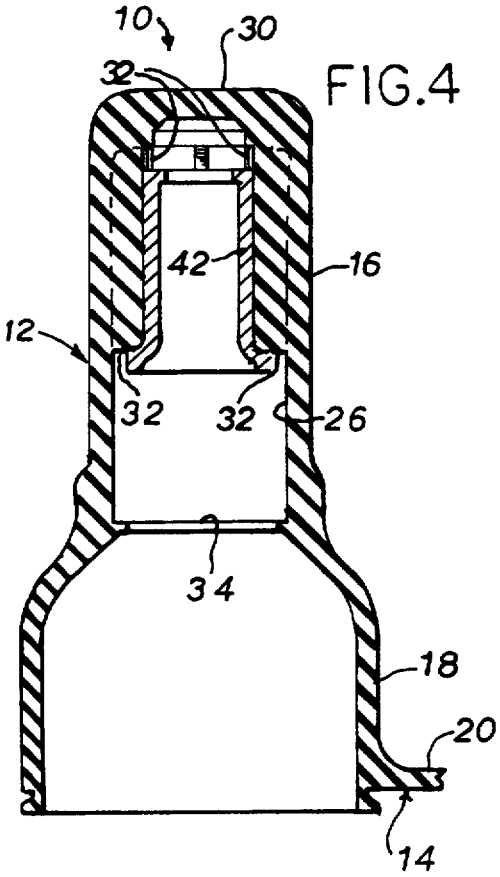
FIG. 4 is a view similar to FIG. 3, but showing a crimp sleeve of one size within the cover.

Referring to FIG. 1, an insulating cover 10 of the invention is especially adapted for quickly and easily insulating a crimp sleeve type wire joint. Crimp sleeves are in common usage for joining two or more wires. A crimp sleeve is simply a tubular somewhat bell shaped sleeve of electrically conductive metal, such as copper or a copper alloy, which is slipped over stripped ends of wires to be joined and then crimped onto the ends to lock the ends together.

After the joint is formed in well known manner using a crimp sleeve, insulating cover 10 is pulled over the joint and secured thereto. The insulating cover 10 has a cap portion 12 and a stay portion 14. The cap 12 includes a body 16 and a skirt 18 which depends from the open end of the body 16. The stay 14 extends from the opposite end of the skirt and includes a strap 20, a retainer ring 22 and a tab 24. The cover is preferably integrally molded from a flexible, elastic elastomeric material such as neoprene or a plasticized polyvinylchloride.

The body 16 is generally tubular and has an interior surface 26 which defines a lumen 28 within the body 16. An end wall 30 closes off one end of the lumen 28, the opposite end from which the skirt 18 depends being open.

The interior surface 26 defines adjacent to the end wall 30 a plurality of radially spaced apart, longitudinally extending ribs 32. In the preferred embodiment illustrated, eight ribs 32 are shown (see FIG. 3). As shown in FIG. 3, the ribs 32 define a diameter of radius $R_1$ within the lumen 28, which is smaller than the radius $R_2$ of the lumen between the ribs 32 and slightly smaller than the diameter of the smaller of the two crimp caps which the cover may be applied to. In the preferred embodiment, a cover 10 having a radius $R_1$ of approximately 0.118 inches, a radius $R_2$ of approximately 0.180 inches, a wall thickness T of approximately 0.048 inches and a rib width W of approximately 0.020 inches can be used to cover a crimp sleeve having a major outside diameter of ¼ inches, and also a crimp sleeve having a major outside diameter of 21/64 inches. As such, insertion of the ¼ inch crimp sleeve into the cover 10 results in a tight fit of the crimp sleeve within the radius $R_1$, with the ribs 32 slightly compressed (FIG. 4). Insertion of the 21/64 inch crimp sleeve into the cover 10 results in the ribs 32 folding over and being compressed between the crimp sleeve and the wall of the body 16 (FIGS. 5 and 6), with the body 16 also being expanded outwardly somewhat.

The ends of the ribs 32 are arcuately shaped, so as to roughly conform to the exterior shape of the flared end of a crimp sleeve, as shown in FIG. 4. Spaced toward the open end of the lumen 28 from the arcuate ends of the ribs 32, the interior surface 26 defines an annular ledge 34. The outer diameter of the annular ledge 34 is approximately of radius $R_2$ and the inner diameter of the ledge 34 is approximately 0.325 inches in the preferred embodiment, so as to engage the end of the larger crimp sleeve.

In FIG. 4, a relatively shorter, smaller diameter crimp sleeve 42 is illustrated nested within the ribs 32. In this position, the ribs 32 preferably provide a light interference fit with the crimp sleeve 42, so that friction between the ribs 32 and the crimp sleeve 42 helps hold the cover 10 on the crimp sleeve.

Figure 5:
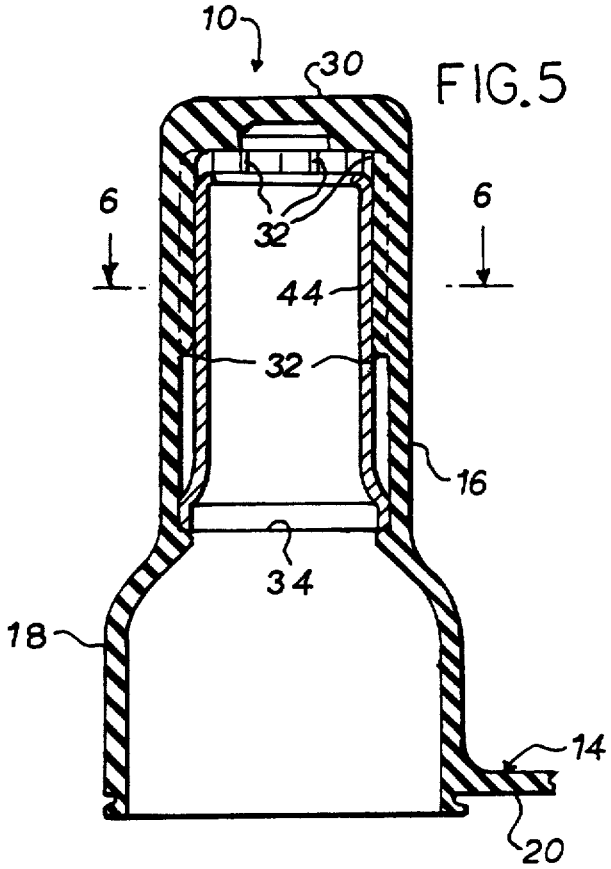
FIG. 5 is a view similar to FIG. 4, but showing a crimp sleeve of a larger size within the cover.
Figure 6:
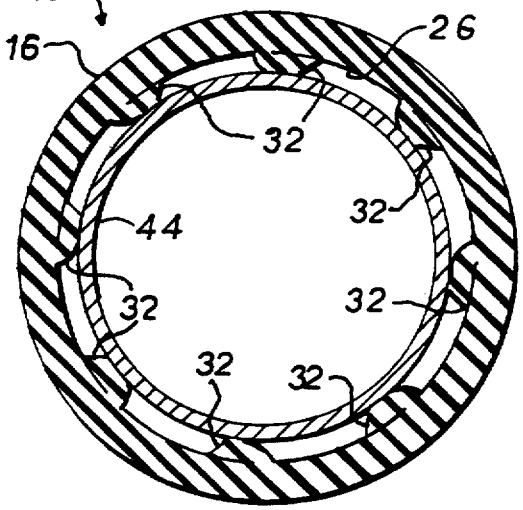
FIG. 6 is a cross-sectional view taken along the plane of the line 6—6 of FIG. 5.

Referring to FIGS. 5 and 6, a relatively longer and larger diameter crimp sleeve 44 is shown with its open end resting on the annular ledge 34. The sleeve 44 is also engaged by the ribs 32. Since the sleeve 44 is of a considerably larger radius than the radius $R_1$ defined by the ribs 32, the ribs 32 fold over into the spaces between the sleeve 44 and the cylindrical wall of the body 16. The insertion of the sleeve 44 into the cover 10 stretches the cover 10 to expand the lumen 28 and compress the ribs 32 between the crimp sleeve 44 and the body 16.

The skirt 18 depends from the open end of the body 16 and flares outwardly therefrom so as to define an opening into the lumen 28 of the body 16. The skirt 18 is relatively thin walled so as to be extremely flexible. The strap 20 is also thin, so as to be elastically stretchable. After the cap portion 12 is slipped over a crimp sleeve of a wire joint, the strap 20 is pulled between the crotch defined between the wires of the joint and the ring 22 slipped over the body 16, so as to secure the cover 10 on the joint, as illustrated in FIG. 1. The ring 22 is of an internal diameter so as to fit over the body 16 but not over the skirt 18, so that it is secured at the junction between the body and the skirt.

Figure 7:
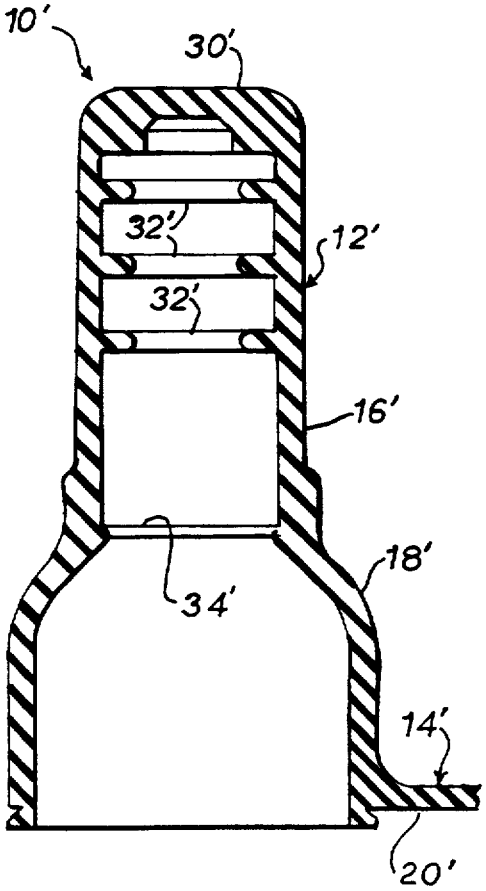
FIG. 7 is a view similar to FIG. 3 of a second embodiment of an insulating cover of the invention.

FIG. 7 illustrates an alternate embodiment of a cover 10' of the invention. The cover 10' is the same in all respects as the cover 10, except that the ribs 32' are annular and coaxial with the axis of the lumen 28'. Although the wall thickness of the body 16 is relatively large at the ribs 32', it is relatively small between the ribs 32' to allow the body 16 to stretch circumferentially and the ribs 32' to fold over to accommodate both a smaller diameter and a larger diameter crimp sleeve.

Preferred embodiments of the invention have been described in considerable detail. Many modifications and variations of the preferred embodiment will be apparent to those of ordinary skill in the art but which will still embody the spirit and scope of the invention. Therefore, the invention should not be limited by the scope of the description of the preferred embodiments, but only by the claims which follow.

We claim:

1. A cover for electrically insulating a wire joint, comprising:

an elastic generally tubular body having an interior surface defining a lumen, one end of said lumen being closed by a wall of said body and an opposite end of said lumen being open;

a flexible skirt depending from said body at the open end of said lumen, said skirt defining an opening into said lumen;

an elastic strap fixed at one end to the skirt;

a retainer fixed to the strap at an end of the strap which is opposite from the one end which is fixed to the skirt, said retainer being engageable with said body when said cover is placed over a wire joint so that said strap extends through a crotch of said wire joint;

wherein said interior surface of said body includes spaced apart ribs defining an inside diameter within said lumen to fit one size wire joint in a compression fit, said ribs being flexible to deform so as to accommodate insertion of a second size wire joint larger than said one size.

2. A cover as in claim 1, wherein said ribs fold over upon insertion of said second size wire joint.

3. A cover as in claim 1, wherein said ribs extend longitudinally.

4. A cover as in claim 1, wherein said ribs are axially positioned adjacent to said closed end of said lumen.

5. A cover as in claim 1, wherein said ribs are coaxial with said lumen.

6. A cover as in claim 1, wherein said body is made of an elastic material which expands to compress said folded-over ribs between said body and said second size wire joint upon the insertion of said second size wire joint.

* * * * *